US007296353B1

(12) United States Patent
Jackson

(10) Patent No.: US 7,296,353 B1
(45) Date of Patent: Nov. 20, 2007

(54) PACKAGE OPENER

(76) Inventor: Barbara Hicks Jackson, Route 1 Box 1208, Dante, VA (US) 24237-9610

( * ) Notice: Subject to any disclaimer, the term of this patent is extended or adjusted under 35 U.S.C. 154(b) by 280 days.

(21) Appl. No.: 11/028,106

(22) Filed: Jan. 3, 2005

(51) Int. Cl.
*B26B 3/00* (2006.01)

(52) U.S. Cl. ..... 30/2; 30/171; 30/317

(58) Field of Classification Search ..... 30/2, 30/169, 171, 280, 294, 314, 315, 317, 355, 30/356, 90.1, 357; D32/40, 46, 49, 51
See application file for complete search history.

(56) References Cited

U.S. PATENT DOCUMENTS

| | | | | | |
|---|---|---|---|---|---|
| 52,092 | A | * | 1/1866 | Tevis | 30/121.5 |
| 394,547 | A | | 12/1888 | Thacker | |
| 776,191 | A | * | 11/1904 | Lynch | 7/144 |
| 790,228 | A | * | 5/1905 | Rohrer | 30/121.5 |
| 1,171,738 | A | * | 2/1916 | Mallet | 15/144.1 |
| 1,422,773 | A | * | 7/1922 | McCarthy | 30/164.9 |
| 1,928,187 | A | * | 9/1933 | Radel | 30/299 |
| 2,179,758 | A | * | 11/1939 | Schlueter | 452/105 |
| 2,541,559 | A | * | 2/1951 | Gaetana | 30/136 |
| 2,646,621 | A | * | 7/1953 | Paul | 30/317 |
| 2,718,700 | A | * | 9/1955 | Karl | 30/318 |
| 2,747,911 | A | * | 5/1956 | Kuever | 99/450 |
| 3,530,524 | A | * | 9/1970 | Clemans | 15/236.08 |
| 3,742,787 | A | | 7/1973 | Whiteford | |
| 3,935,762 | A | | 2/1976 | Tudisco | |
| 4,003,418 | A | | 1/1977 | Andersson | |
| 4,086,699 | A | * | 5/1978 | Olkkola | 30/172 |
| 4,086,831 | A | | 5/1978 | Smith | |
| 4,398,314 | A | | 8/1983 | Converse et al. | |
| 4,407,086 | A | | 10/1983 | Hasselmann | |
| 4,448,097 | A | | 5/1984 | Rocca | |
| 4,663,848 | A | | 5/1987 | Sell | |
| 4,667,362 | A | * | 5/1987 | Mattingly | 15/236.08 |
| 4,716,798 | A | * | 1/1988 | Flint | 83/13 |
| 4,805,307 | A | * | 2/1989 | Lucas et al. | 30/294 |
| 5,129,157 | A | * | 7/1992 | Wood | 30/526 |
| 5,169,999 | A | | 12/1992 | Jenkins | |
| D341,455 | S | * | 11/1993 | Roma et al. | D32/49 |
| 5,555,624 | A | | 9/1996 | McCracken | |
| 5,729,854 | A | * | 3/1998 | Powers | 7/109 |
| 5,884,837 | A | * | 3/1999 | Jacobsson et al. | 229/204 |
| 6,079,298 | A | | 6/2000 | Gasperi et al. | |
| 6,314,644 | B1 | * | 11/2001 | Raeker | 30/2 |

* cited by examiner

*Primary Examiner*—Hwei-Siu C. Payer
(74) *Attorney, Agent, or Firm*—Michael I Kroll

(57) ABSTRACT

An apparatus for opening packages having a handle with a shaft extending outwardly therefrom. A cutting member is connected to the shaft at an end opposite the handle. The cutting member is selectively positionable between a seal and a container and upon moving the cutting member along a length of the seal, the seal is removed from the container.

3 Claims, 5 Drawing Sheets

PACKAGE OPENER

BACKGROUND OF THE INVENTION

1. Field of the Invention

The present invention relates generally to package openers and, more specifically, to a device for opening packages that are shrink wrapped, including but not limited to CD, VCR and DVD cases and other tightly wrapped cartons. The present invention is designed to tear and pull the shrink-wrap material thereby making it easy and safe\ to open. The device is equipped with cutting teeth that provide versatility by enabling it to penetrate and tear cardboard cartons along with plastic shrink wrap material. The package opening device of the present invention is versatile and may be used to open a multitude of products.

2. Description of the Prior Art

There are other package openers designed for similar purposes. Typical of these is U.S. Pat. No. 394,547 issued to D. W. Thacker on Dec. 11, 1888.

A patent was issued to C. L. Whiteford on Jul. 3, 1973 as U.S. Pat. No. 3,742,787. Yet another U.S. Pat. No. 3,935,762 was issued to V. J. Tudisco on Feb. 3, 1976 and still yet another was issued on May 2, 1978 to L. T. Smith as U.S. Pat. No. 4,086,831.

Another patent was issued to G. A. Converse et al. on Aug. 16, 1983 as U.S. Pat. No. 4,398,314. Yet another U.S. Pat. No. 4,003,418 was issued to A. Anderson on Jan. 18, 1977. Another was issued to W. J. Hasselmann on Oct. 4, 1983 as U.S. Pat. No. 4,407,086 and still yet another was issued on May 15, 1984 to D. Rocca as U.S. Pat. No. 4,448,097.

Another patent was issued to A. Sell on May 12, 1987 as U.S. Pat. No. 4,663,848. Yet another U.S. Pat. No. 5,169,999 was issued to D. W. Jenkins on Dec. 8, 1992. Another was issued to B. McCracken on Sep. 17, 1996 as U.S. Pat. No. 5,555,624 and still yet another was issued on Jun. 27, 2000 to N. C. Rittman Gasperi et al. as U.S. Pat. No. 6,079,298.

U.S. Pat. No. 395,547

Inventor: D. W. Thacker

Issued: Dec. 11, 1888

A tool comprising a middle part or handle having a curved claw at one end and a notched pry or nail extractor at its opposite end, and having a transverse cylinder between said handle and said pry, the ends of which serve as hammer faces and the projecting sides as fulcrums for the pry and the nail extractor.

U.S. Pat. No. 3,742,787

Inventor: Carlton L. Whiteford

Issued: Jul. 3, 1973

A hand tool employs a generally spherical handle with a housing and a drive member seated therewithin for engagement of a tool member for positive drive action in one direction. One-way clutch means within the housing permits relative rotation of the drive member in a first direction and interengagement for joint movement in the direction opposite thereto.

U.S. Pat. No. 3,935,762

Inventor: Vincent J. Tudisco

Issued: Feb. 3, 1976

A tool assembly for mounting bits includes a tubular shank with an enlarged end portion in which is seated a tool bit receiving socket and its other end inserted into a handle. The socket has a cavity opening at the outer end in which is seated the body portion of tool bits. Releasable retaining means in the cavity retains the inserted tool bits which seat against a shoulder therewithin. The socket itself has a peripheral collar seated against the end of the shank and seats internally against a shoulder within the cavity of the shank provided by the enlarged end portion.

U.S. Pat. No. 4,086,831

Inventor: Lloyd T. Smith

Issued: May 2, 1978

A screwdriver including a relatively large teardrop-shaped, hollow handle, comfortable to the hand for delivering increased turning power, is provided with a self-contained ratchet mechanism which, in turn, has a three-position ratchet control (forward, reverse and lock). The shank of the screwdriver houses a magnet for releasably holding any one of a number of bits in place during use. The handle has a series of finger-engageable projections on its stem to assist the operator in applying torque and for storage of bits therein. A retainer ring on the stem holds the bits in the chambers until indexed to a bit-releasing position.

U.S. Pat. No. 4,398,314

Inventor: Gregg A. Converse et al.

Issued: Aug. 16, 1983

The box top opener is of one piece molded plastics material and includes an elongated reinforced handle portion having reinforced box top gripping jaws extending from one end thereof. The jaws are comprised of a pair of flat parallel closely spaced apart plates adapted to receive the box top therebetween. The upper jaw has a rectangular configuration and the lower jaw has a triangular configuration with the edges thereof beveled to facilitate insertion under the box top whereby upon lifting of the handle the portion of the box top engaged between the jaws will be separated from the sides of the box and lifted upwardly to provide access to the contents of the box.

U.S. Pat. No. 4,003,418

Inventor: Allan Anderson

Issued: Jan. 18, 1977

A combination tool comprising a ball-shaped handle member and at least three substantially straight work-engaging members projecting substantially radially from said ball-shaped handle member, the tips of said work-engaging members defining a plane spaced from the surface of said handle member. At least three orientation rings are provided, each extending along the intersection of the surface of the handle member with a plane extending through the handle member center at right angles to one of the work-engaging members.

U.S. Pat. No. 4,407,086

Inventor: William J. Hasselmann

Issued: Oct. 4, 1983

Apparatus for removing a musket ball undesirably lodged in the breech of a muzzle-loading gun. The apparatus includes a ramrod to one end of which a ball starter is secured firmly but manually removable and to the opposite end of which a screw-jag tool is similarly secured. Using the grip of the ball starter as a handle, the tool is screwed into the musket ball and is then withdrawn through the barrel. To prevent rotation of the grip of the ball starter relative to its shaft when the musket ball is being engaged and disengagement of the ball of the ball starter when the musket ball is being pulled out, the shaft of the ball starter is keyed to its grip. Normally the ramrod is carried on the gun and the ball starter and screw-jag tool are carried in the pouch with the bullets and powder.

U.S. Pat. No. 4,448,097

Inventor: David Rocca

Issued: May 15, 1984

A driver tool utilizing a sleeve which fits within and rotates with an elongated shaft. Driving bits are held to the sleeve and turned by the action of the rotating shaft. A handle which is expandable connects to the elongated shaft.

U.S. Pat. No. 4,663,848

Inventor: Anthony Sell

Issued: May 12, 1987

Scissors have a pair of pivotally interconnections blades and a ball-shaped handle. One embodiment has a pair transversely spaced, outwardly-convex, partly ball-shaped handle members at the rear end portions of the blades and an elastomeric member compressibly interposed between the handle members biasing the blades toward an open position. The handle members and elastomeric member have complementary, partly ball shapes providing an overall external configuration of a single ball. Another embodiment has a hollow, flexible ball completely covering and enclosing partially ball shaped handle members, the pivotal interconnections between the blades is concealed within the ball shaped covering, and a formed wire spring member is anchored at the interconnections and its opposite ends are seated against inner surfaces of the handle members. In each embodiment, manual squeezing pressure applied by a user's palm or fingers closes the blades against the bias of the elastomeric or wire spring member.

U.S. Pat. No. 5,169,999

Inventor: Danny W. Jenkins

Issued: Dec. 8, 1992

A holder for carrying a ball starter on the barrel on a muzzle loading and/or black powder rifle. The holder, secured to the rifle barrel, presents ready access to the ball starter and precludes any previously encountered inconvenience in locating the ball starter on the person of the user or in the general vicinity of use. The holder is conveniently mounted and provision is made for the selective retention of the ball starter thereon, i.e. from release from a stored position to positive placement at such storage position.

U.S. Pat. No. 5,555,624

Inventor: Brian McCracken

Issued: Sep. 17, 1996

A package opener that can be used safely to open packages, such as jewel boxes containing compact discs, that are encapsulated within thin outer coverings. The device includes an edge guide channel into which a cutting edge extends so that the device can be guided along a selected edge of the package to precisely cut the covering to permit its easy removal from the package.

U.S. Pat. No. 6,079,298

Inventor: Nancy C. Rittmann Gasperi et al.

Issued: Jun. 27, 2000

A palm driver has a rotatable drive member and an ergonomic handle body connected to the drive member through a ratchet mechanism and covered by a cushioning grip. The handle body is asymmetrically curved and is substantially continuously convex along portions engageable in use with the user's hand, having a generally flattened top surface opposite the drive member and receivable in the user's palm, and a peripheral side surface which has a plan outline which is continuously convex and has a generally flattened heel portion and an opposed, much smaller radius finger portion, respectively engageable with the heel and fingers of the user's hand in use.

While these package-opening devices may be suitable for the purposes for which they were designed, they would not be as suitable for the purposes of the present invention, as hereinafter described.

SUMMARY OF THE PRESENT INVENTION

The present invention relates generally to package openers and, more specifically, to a device for opening packages that are shrink wrapped, including but not limited to CD, VCR and DVD cases and other tightly wrapped cartons. The present invention is designed to tear and pull the shrink-wrap material thereby making it easy and safe\ to open. The device is equipped with cutting teeth that provide versatility by enabling it to penetrate and tear cardboard cartons along with plastic shrink wrap material. The package opening device of the present invention is versatile and may be used to open a multitude of products.

A primary object of the present invention is to provide a package opener that overcomes the shortcomings of the prior art.

Another object of the present invention is to provide a package opener that enables the user to easily remove shrink-wrap material from packaged items such as jewel cases, DVD cases, small cartons and the like.

Another object of the present invention is to provide a package opener having a bulbous handle to facilitate manipulation by user's that are hindered by arthritis and other such afflictions.

Still another object of the present invention is to provide a package opener having a cutting member with a plurality of cutting teeth extending perpendicularly from a shaft.

Another object of the present invention is to provide a package opener that will provide a safer means for opening packaging that often requires the use of awkward cutting utensils such as knives and scissors that are not duly constructed for the use thereof.

Yet another object of the present invention is to provide a package opener that is simple and easy to use.

Still yet another object of the present invention is to provide a package opener that is inexpensive to manufacture and operate.

Additional objects of the present invention will appear as the description proceeds.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DETAILED DESCRIPTION OF THE PREFERRED EMBODIMENT

Figure 1:
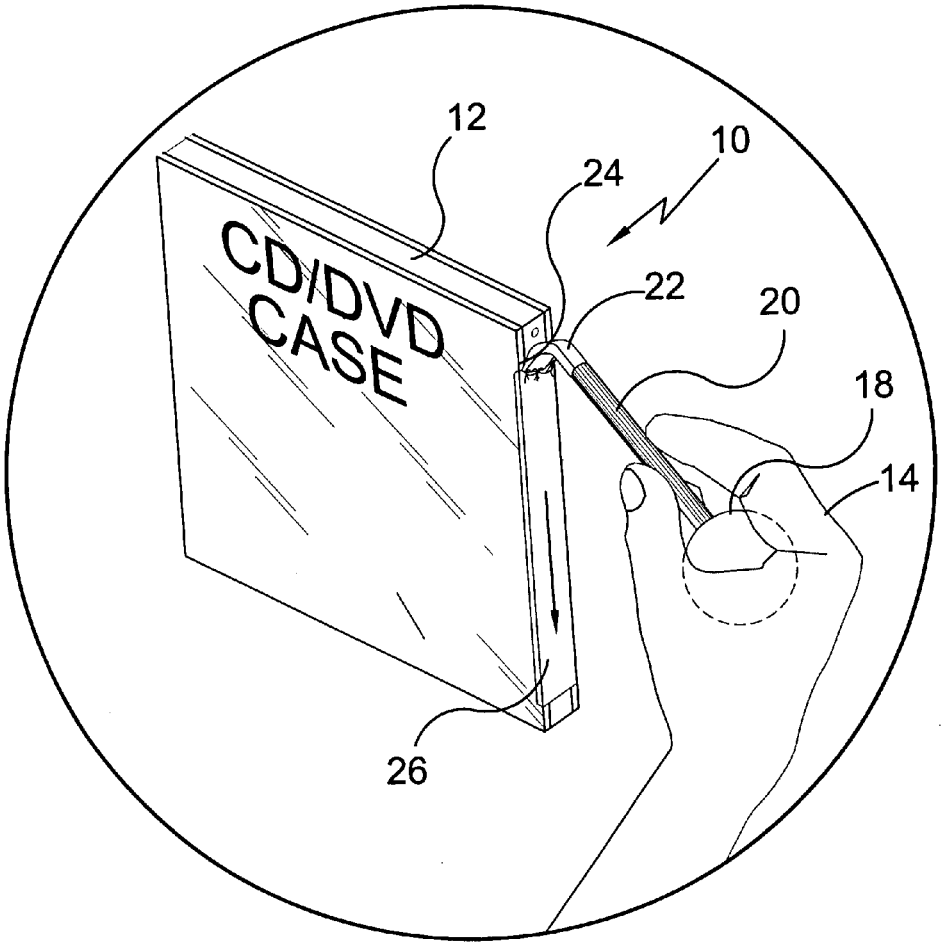
FIG. 1 is an illustrative view of the package opener of the present invention in use.

The following discussion describes in detail one embodiment of the invention (and several variations of that embodiment). This discussion should not be construed, however, as limiting the invention to those particular embodiments. Practitioners skilled in the art will recognize numerous other embodiments as well. For definition of the complete scope of the invention, the reader is directed to appended claims.

Turning now descriptively to the drawings, in which similar reference characters denote similar elements throughout the several views, FIGS. 1 through 5 illustrate the package opener of the present invention which is indicated generally by the numeral 10.

The package opener 10 of the present invention is shown illustratively in FIG. 1. Shown herein, a user 14 is opening a sealed CD/DVD case 12 with the package opener 10 of the present invention. The package opener 10 comprises a shaft 20 having a first end and a second end. The shaft 20 of the package opener 10 is made of a non-slip material in order to prevent slippage. A handle 18 is attached to the first end of shaft 20. The handle 18 is preferably bulbous in shape to allow for an easier and more comfortable hand held position. However, the handle 18 maybe formed in any shape that allows for comfortable gripping by a user 14. A cutting member 22 is attached to the second end of shaft 20. The cutting member 22 is substantially L-shaped and includes a plurality of teeth 24 positioned at an end of the cutting member not connected to the shaft 20. The cutting teeth 24 are positioned on a section of the L-shaped cutting member 22 that is substantially perpendicular to the shaft 20.

The way in which the package opener 10 of the present invention is used will now be described with respect to FIG. 1. Initially, the user 14 grips the bulbous handle 18 in a the palm of the users hand and wrap fingers around the shaft 20 to steady the opener 10 in the user's hand. The user 14 then places the teeth 24 of the cutting member 22 in contact with each of a seal 26 and the container 12. Preferably, the user positions the teeth 24 at an edge of the seal 26 and between the seal 26 and the container 12. Thereafter, the user applies pressure to the shaft 20 and the cutting member 22 is moved along a length of the seal 26 so as to at least one of pierce, peel and remove the seal 26 of the case 12.

As shown herein, the seal 26 is a sticker that covers an edge of the case 12. However, the seal 26 is object or mechanism used to prevent access to an object retained within a case. This includes but is not limited to shrink wrap that covers all surfaces of the case as well as plastic film that covers and is sealed around the case.

Figure 2:
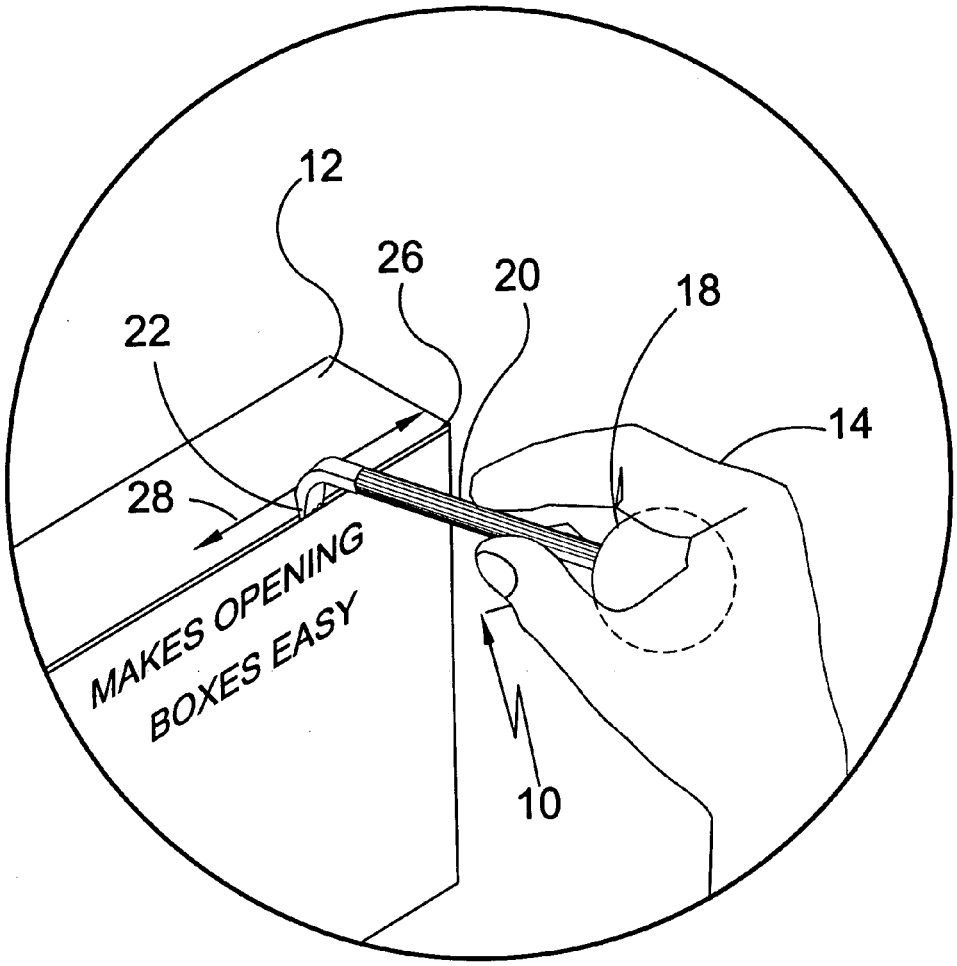
FIG. 2 is an illustrative view of the package opener of the present invention in use opening a box top.

FIG. 2 is an illustrative view of the package opener of the present invention in use. The package opener 10 comprises a shaft 20 having a first end and a second end. The shaft 20 of the package opener 10 is made of a non-slip material in order to prevent slippage. A handle 18 is attached to the first end of shaft 20. The handle 18 is preferably bulbous in shape to allow for an easier and more comfortable hand held position. However, the handle 18 maybe formed in any shape that allows for comfortable gripping by a user 14. A cutting member 22 is attached to the second end of shaft 20. The cutting member 22 is substantially L-shaped and includes a plurality of teeth 24 positioned at an end of the cutting member not connected to the shaft 20. The cutting teeth 24 are positioned on a section of the L-shaped cutting member 22 that is substantially perpendicular to the shaft 20.

The user 14 applies pressure against the shaft 20 thereby penetrating the wrapper/seal 26 with the teeth 24 of the cutting member 22. The package opener 10 is moved along the length of the seal 26 in a direction indicated by the bi-directional arrow labeled with the reference numeral 28 thereby breaking the seal 26 and opening the case 12. The device allows people that suffer from arthritis and other hand related problems to be able to open plastic shrink wrap items and various other items such as boxes in an easy and safe manner. The packaging opener is a versatile tool that may be used in various ways to aid the user in opening many types of wrapped and packaged items.

Additionally, the package opener 10 can be used to tear open an unsealed light weight carton, including but not limited to a cosmetics box. In one embodiment, the user 14 inserts the cutting member into the seam of the box and pulls the package opener 10 at a substantially 45 degree angle to tear the top from the box.

Figure 3:
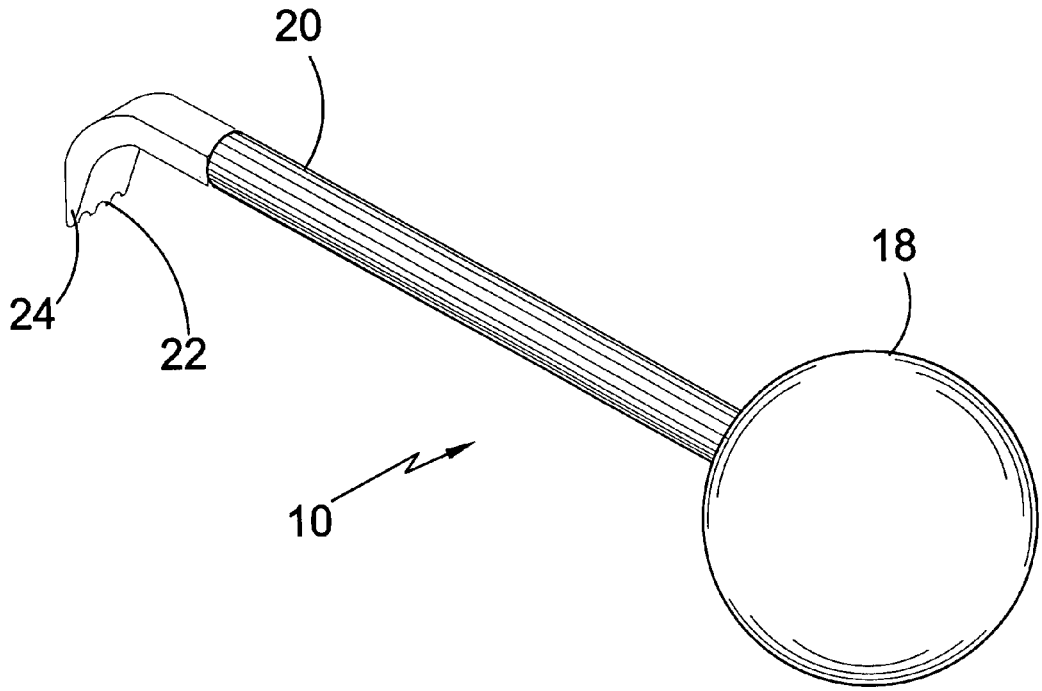
FIG. 3 is a perspective view of the present invention.

FIG. 3 is a perspective view of the package opener of the present invention. The package opener 10 comprises a shaft 20 having a first end and a second end. The shaft 20 of the package opener 10 is made of a non-slip material in order to prevent slippage. A handle 18 is attached to the first end of shaft 20. The handle 18 is preferably bulbous in shape to allow for an easier and more comfortable hand held position. However, the handle 18 maybe formed in any shape that allows for comfortable gripping by a user 14. A cutting member 22 is attached to the second end of shaft 20. The cutting member 22 is substantially L-shaped and includes a plurality of teeth 24 positioned at an end of the cutting member not connected to the shaft 20. The cutting teeth 24 are positioned on a section of the L-shaped cutting member 22 that is substantially perpendicular to the shaft 20.

Figure 4:
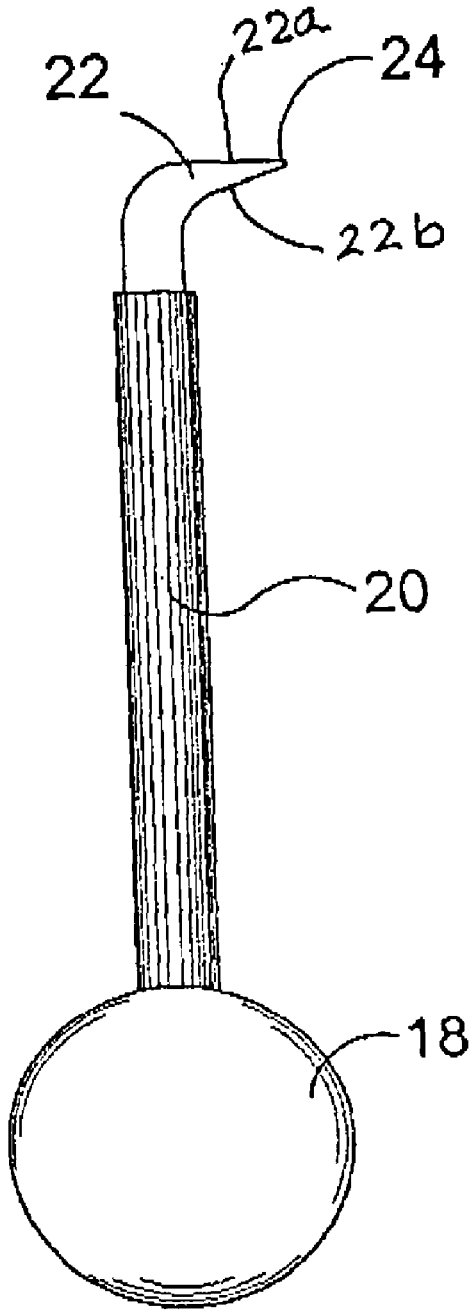
FIG. 4 is a side view of the present invention.

FIG. 4 is a side view of the package opener 10 of the present invention. The package opener 10 comprises a shaft 20 having a first end and a second end. The shaft 20 of the package opener 10 is made of a non-slip material in order to prevent slippage. A handle 18 is attached to the first end of shaft 20. The handle 18 is preferably bulbous in shape to allow for an easier and more comfortable hand held position. However, the handle 18 maybe formed in any shape that allows for comfortable gripping by a user 14. A cutting member 22 is attached to the second end of shaft 20. The cutting member 22 is substantially L-shaped and includes a plurality of teeth 24 positioned at an end of the cutting member not connected to the shaft 20. The cutting teeth 24 are positioned on a section of the L-shaped cutting member 22 that is substantially perpendicular to the shaft 20.

As illustrated in FIG. 4, sides 22*a* and 22*b* of cutting member 22 form a wedge.

Figure 5:
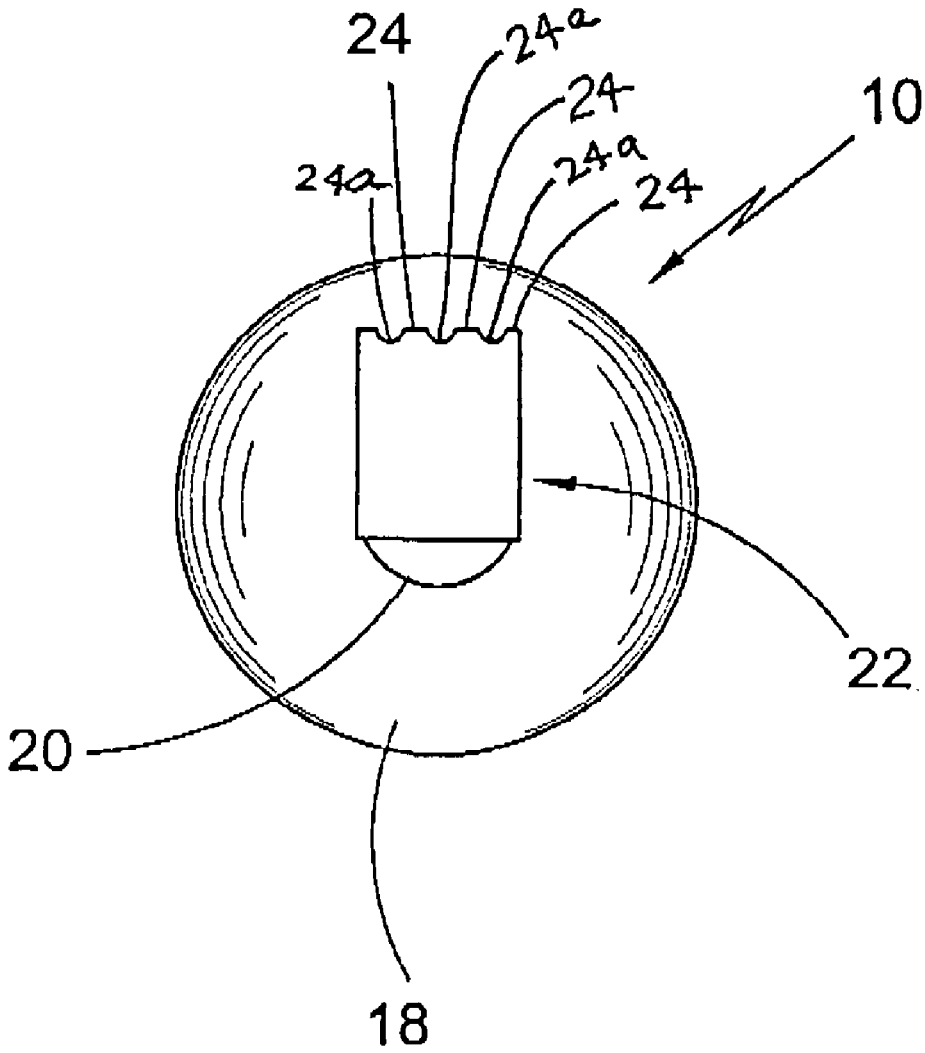
FIG. 5 is a top view of the present invention.

FIG. 5 is a top view of the package opener 10 of the present invention. The package opener 10 comprises a shaft 20 having a first end and a second end. The shaft 20 of the package opener 10 is made of a non-slip material in order to prevent slippage. A handle 18 is attached to the first end of shaft 20. The handle 18 is preferably bulbous in shape to allow for an easier and more comfortable hand held position. However, the handle 18 maybe formed in any shape that allows for comfortable gripping by a user 14. A cutting member 22 is attached to the second end of shaft 20. The cutting member 22 is substantially L-shaped and includes a plurality of teeth 24 positioned at an end of the cutting member not connected to the shaft 20. The cutting teeth 24 are positioned on a section of the L-shaped cutting member 22 that is substantially perpendicular to the shaft 20.

As illustrated in FIG. 5, teeth 24 are aligned and separated by concave shaped serrations 24*a*.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by letters Patent is set forth in the appended claims:

1. An apparatus for opening packages comprising:

a. a handle having a shaft extending outwardly therefrom;

b. a cutting member connected to said shaft at an end opposite said handle; wherein said cutting member is selectively positionable between a seal and a container and upon moving said cutting member along a length of said seal, said seal is removed from said container;

c. said cutting member comprising an L-shaped blade with a free end of a first leg of said blade attached to said shaft and a distal end of a second leg of said blade terminating in a cutting edge; and d. said cutting edge having aligned straight cutting teeth and concave shaped serrations separating said teeth from each other, said second leg having wedge shaped sides terminating in said cutting edge.

2. The apparatus as recited in claim 1, wherein said handle is substantially round and bulbous thereby fitting comfortably within a palm of a user's hand.

3. The apparatus as recited in claim 2, wherein said cutting member is curvilinear in shape.

* * * * *